US006388180B1

(12) United States Patent
Buttice-Cannon

(10) Patent No.: US 6,388,180 B1
(45) Date of Patent: May 14, 2002

(54) SLIP-ON COVER FOR A GUITAR STAND CRADLE

(76) Inventor: Elizabeth Buttice-Cannon, 331 1/2 N. Hayworth Ave., Los Angeles, CA (US) 90048

( * ) Notice: Subject to any disclaimer, the term of this patent is extended or adjusted under 35 U.S.C. 154(b) by 0 days.

(21) Appl. No.: 09/816,903

(22) Filed: Mar. 23, 2001

(51) Int. Cl.[7] ..... G10G 7/00
(52) U.S. Cl. ..... 84/453; 84/327
(58) Field of Search ..... 84/453, 327, 421

(56) References Cited

U.S. PATENT DOCUMENTS

| | | | | |
|---|---|---|---|---|
| 4,177,847 A | | 12/1979 | Spindler | 150/52 |
| 5,375,497 A | * | 12/1994 | Pirchio et al. | 84/327 |
| 5,378,522 A | | 1/1995 | Laomarsino | 428/100 |
| 5,508,078 A | | 4/1996 | Stalnaker | 428/71 |
| 5,522,433 A | | 6/1996 | Nygaard | 138/149 |
| 5,959,225 A | * | 9/1999 | Hsu | 84/327 |
| 6,127,612 A | * | 10/2000 | Yu | 84/327 |

* cited by examiner

*Primary Examiner*—Shih-Yung Hsieh
(74) *Attorney, Agent, or Firm*—Goldstein Law Offices, P.C.

(57) ABSTRACT

Slip-on covers for covering the cradle portions of a guitar stand. A guitar stand has a neck cradle and a body cradle for supporting a guitar. The covers are cylindrical pieces of soft fabric, having a top edge and an open bottom edge. A string is stitched to the inside surface of each cover, the string extending through the entire length of the cover, past the open bottom edge. A strip of hook and loop fasteners extends outward from the top edge of the cover. In use, the cover is slid downward over the arm. Once in place over the arms, the strings from each pair of covers are tied together in order to secure the covers in place. The strips of hook and loop fasteners are stretched around the circumference of the cover and secured thereto. Once the covers are in place, the guitar may be rested thereupon without fear of damage.

4 Claims, 3 Drawing Sheets

SLIP-ON COVER FOR A GUITAR STAND CRADLE

BACKGROUND OF THE INVENTION

The invention relates to a slip-on cover for a guitar stand cradle. In particular, the invention is a cover that is positioned over the existing material on the cradle portions of a guitar stand in order to protect the guitar from damage inflicted from contact with the stand.

Because of the expense of purchasing different types of instruments, the owners try to maintain the instruments in good condition to prolong their use. In particular, guitars are known to be especially fragile because of their lacquer-type finish that is easily scratched or marred. Further, the body of the guitar may be exposed to general wear and tear due to moisture and friction from the player's hand, as well as friction from the guitar's contact with the musician's clothing.

When not in use, guitars are typically kept on specially designed stands. The stands are equipped with a body cradle and a neck cradle, on which the body and neck of the guitar rests, respectively. These cradle portions are typically surfaced with a rubber coating. This coating may cause chafing on the guitar's finish from repeated contact.

Thus, there exists a need for a device which may be used to cover the rubber on these cradle portions and therefore protect the guitar from damage. Such a device would provide a shielding barrier between the stand and the instrument.

While the available units may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved slip-on cover for a guitar stand cradle. As such, the general purpose of the present invention, which will be described subsequently in greater detail, is to provide a new and improved slip-on cover for a guitar stand cradle which has all the advantages of the prior art and none of the disadvantages.

To attain this, the present invention essentially comprises slip-on covers for covering the cradle portions of a guitar stand. A guitar stand has a neck cradle and a body cradle for supporting a guitar. The covers are cylindrical pieces of fabric, having a top edge and an open bottom edge. A string is stitched to the inside surface of each cover, the string extending through the entire length of the cover, past the bottom edge. A strip of hook and loop fasteners extends laterally outward from the top edge of the cover. In use, the cover is slid downward over the arm. Once in place over the arms, the strings from each pair of covers are tied together in order to secure the covers in place. The strips of hook and loop fasteners are stretched around the circumference of the cover and secured thereto. Once the covers are in place, the guitar may be rested thereupon without fear of damage.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved slip-on cover for a guitar stand cradle which has all the advantages of the prior art and none of the disadvantages.

It is another object of the present invention to provide a new and improved slip-on cover for a guitar stand cradle which may be easily and efficiently manufactured and marketed.

It is a further object of the present invention to provide a new and improved slip-on cover for a guitar stand cradle which is of durable and reliable construction.

An even further object of the present invention is to provide a new and improved slip-on cover for a guitar stand cradle which is susceptible to a low cost of manufacture with regard to both materials and labor, and which accordingly is then susceptible of low prices of sale to the consuming public, thereby making such slip-on cover for a guitar stand cradle economically available to the buying public.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
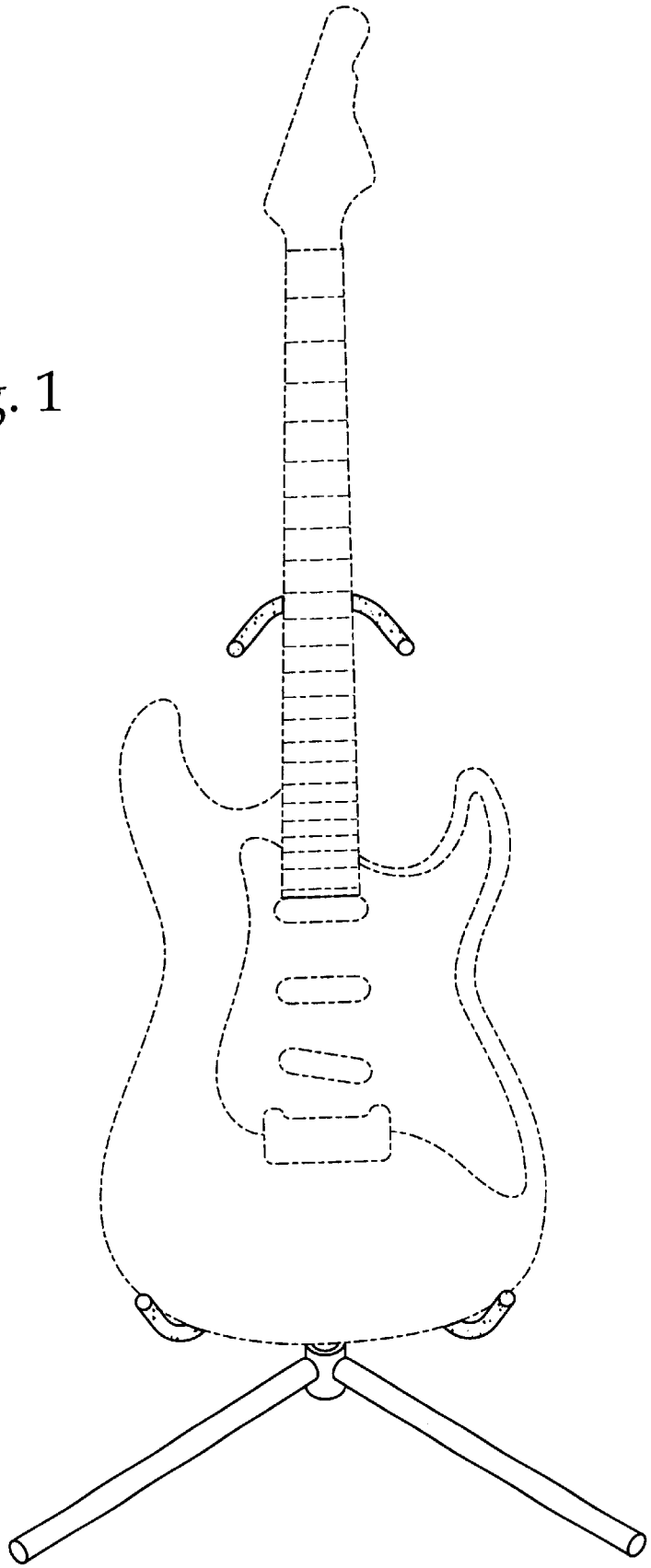
FIG. 1 is a front perspective view of a guitar stand, with a guitar in place on the stand shown in phantom lines.

FIG. 1 illustrates a guitar stand 10 with a guitar 12 resting upon said stand 10. A standard guitar 12 comprises a body 14 and a neck 16. When not in use, the guitar 12 is usually stored on the stand 10 in order to avoid damage to said guitar 12.

Figure 2:
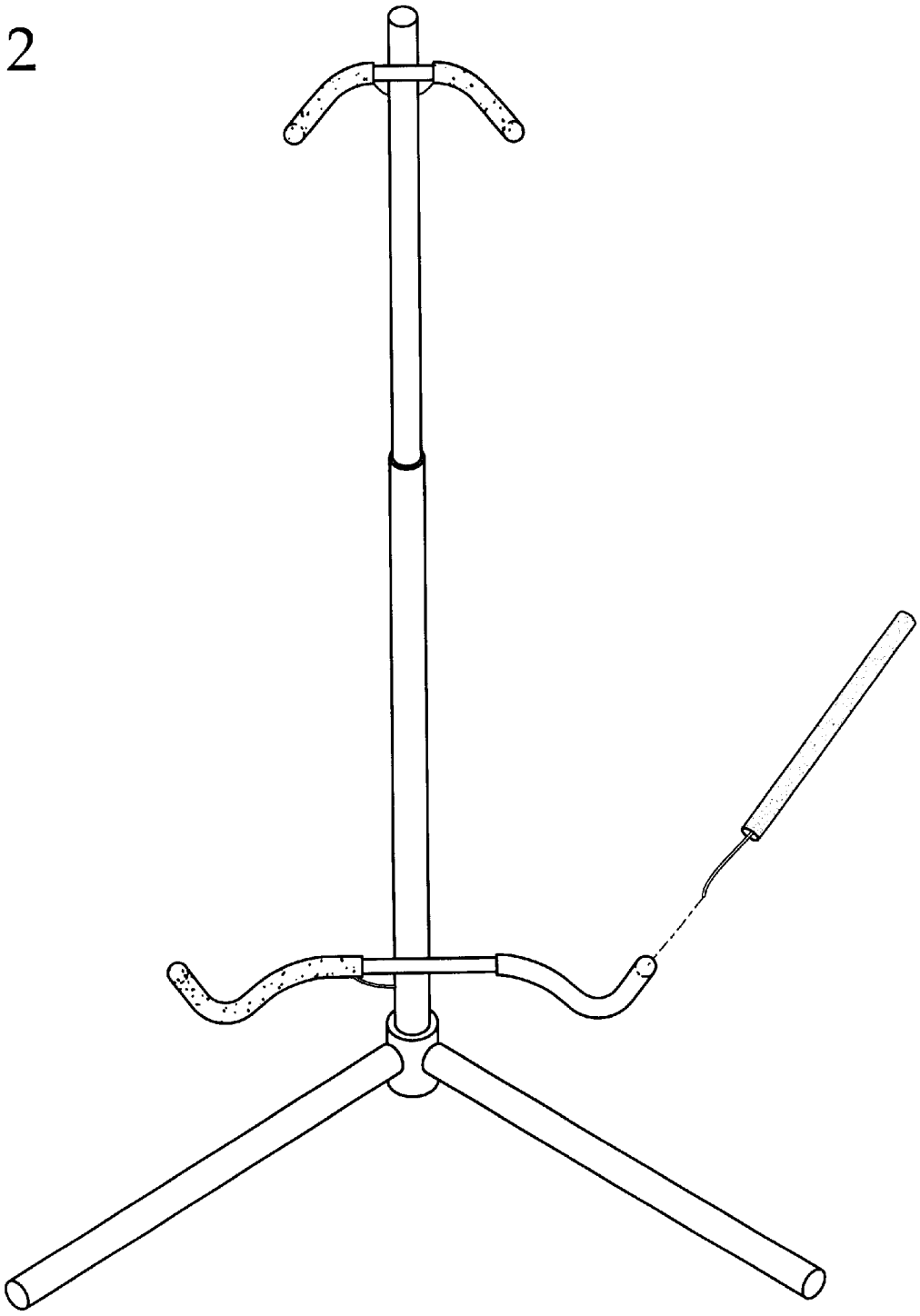
FIG. 2 is an additional front perspective view of the guitar stand, illustrating the slip-on covers in place over the cradle portions.

As illustrated in FIG. 2, the stand 10 comprises a telescoping elongated pole 18, having a top portion 18T and a bottom portion 18B. The height of this pole 18 may be altered in order to accommodate different sized guitars. A neck cradle 20 is mounted to the top portion 18T of the pole 18, while a body cradle 22 is mounted to the bottom portion 18B of said pole. A base 28 is situated at the bottom portion 18B of the pole and serves as a support to the stand 10. A plurality of horizontal legs 30 extend from the base 28 and rest upon the ground surface.

The cradles 20, 22 each have a mid-section 24 and a pair of arms 26 extending horizontally outward therefrom. The mid-section 24 is attached directly onto the pole 18. The arms 26 of the cradles 20, 22 are configured to conform with the portion of the guitar 12 with which they are in communication. In particular, the arms 26 of the neck cradle 20 extend outward at obtuse angles in order to accommodate the neck 16 of the guitar. Similarly, the arms 26 of the body cradle 22 are curved upward, thereby allowing the body portion 14 of the guitar 12 to rest thereupon.

Slip-on covers 32 are applied to the arms 26 of the cradles 20, 22 in order to shield the guitar 12 from damage caused by direct contact with the stand 10. The covers 32 are cylindrical pieces constructed from a padded fabric material, having a top edge 32T and a bottom edge 32B. The bottom edge 32B is open, thus allowing the arms 26 to extend therein fully to the top edge 32T. Each cover 32 has a diameter slightly larger than that of the arms 26. The pair of covers 32 corresponding to the neck cradle 20 are shorter in length than those designed for use with the body cradle 22, as shown in FIGS. 3 and 4.

Figure 3:
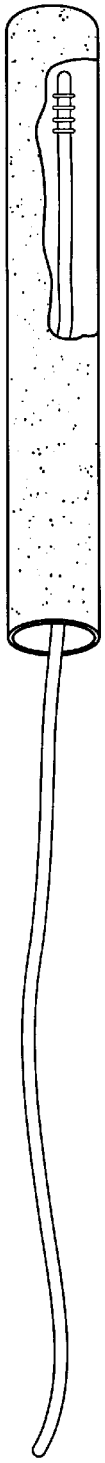
FIG. 3 is a perspective view of the cover, with a portion cut away.
Figure 4:
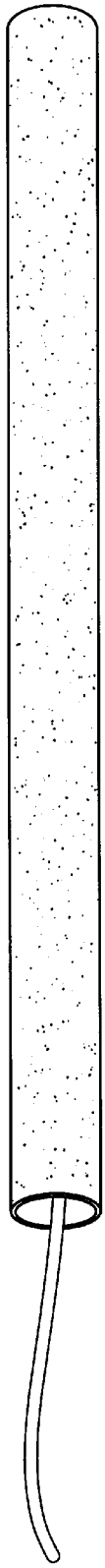
FIG. 4 is a perspective view of the cover.

As illustrated in FIG. 3, a string 34 is stitched to an inside surface of each cover 32 near its top edge 32T, said string 34 extending through the entire length of the cover 32, past the bottom edge 32B. Further, a strip of hook and loop fasteners 36 extends laterally outward from the top edge 32T of the cover 32.

In use, the bottom edge 32B of each cover 32 is brought into contact with its corresponding arm 26, and slid downward over said arm 26 until the cover 32 is filled to the top edge 32T with the arm 26. Once in place over the arms 26, the strings 34 from each pair of covers 32 are tied together in order to secure said covers 32 in place. As added security, the strips of hook and loop fasteners 36 are stretched around the circumference of the cover 32 and secured thereto. Once the covers 32 are in place, the guitar 12 may be rested thereupon without fear of damage.

In conclusion, herein is presented slip-on covers for the cradles of a guitar stand. The invention is illustrated by example in the drawing figures, and throughout the written description. It should be understood that numerous variations are possible, while adhering to the inventive concept. Such variations are contemplated as being a part of the present invention.

What is claimed is:

1. A slip-on cover for covering cradle portions of a guitar stand, said stand having a neck cradle and a body cradle for accommodating a guitar, the cradles having arms extending outward from a mid point for accommodating corresponding parts of a guitar, comprising:

a flexible elongated cylinder constructed from a soft padded fabric material, said cylinder having an interior, a top edge and an open bottom edge in communication with the interior; and a string attached to the interior of the cylinder near the top edge extending through the length of the interior of the cylinder to a point below the bottom edge of said cylinder.

2. The slip-on cover as recited in claim 1, further comprising a strip of hook and loop fasteners positioned at the top edge of the cylinder for securing the cover onto the appropriate arm of the cradle.

3. The slip-on cover as recited in claim 2, comprising four covers of different lengths in order to accommodate the different sized cradle arms.

4. A method of covering a cradle of a guitar stand with slip-on covers, wherein the stand has a neck cradle and a body cradle, each cradle having two arms extending outward from a mid point, and wherein each cover has a top edge, an open bottom edge, a string stitched to an inner surface of the cover, and a strip of hook and loop fasteners positioned at the top edge of the cover, comprising the steps of:

bringing the bottom edge of each cover in contact with the arm to be covered;

sliding the open bottom edge of the cover over said arm until the entire length of the cover is over said arm;

tying the end pieces of the strings of each pair of covers together, thereby securing the covers in place over the arms; and stretching the strip of hook and loop fasteners around the outer surface of the cover, thereby further securing the cover in place.

* * * * *